US007729123B2

(12) United States Patent
Zhao et al.

(10) Patent No.: US 7,729,123 B2
(45) Date of Patent: Jun. 1, 2010

(54) HEAT DISSIPATING ASSEMBLY AND ELECTRONIC DEVICE HAVING SAME

(75) Inventors: Er-Zheng Zhao, Shenzhen (CN); Hai-Yang Yu, Shenzhen (CN); Hong-Wei Zhu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/212,664

(22) Filed: Sep. 18, 2008

(65) Prior Publication Data

US 2009/0290306 A1 Nov. 26, 2009

(30) Foreign Application Priority Data

May 26, 2008 (CN) ..... 2008 1 301780

(51) Int. Cl.
*H05K 7/20* (2006.01)

(52) U.S. Cl. ..... 361/719; 361/679.46; 361/679.47; 361/679.48; 361/695; 361/697; 165/80.3; 165/104.27; 165/104.33; 165/104.34; 174/15.1

(58) Field of Classification Search ..... 361/679.49, 361/689, 690–697, 714–712, 717–724, 679.46–679.48; 165/80.3, 121, 122, 104.33, 185; 174/15.1, 174/16.1, 16.3, 252; 415/126, 127, 203–206, 415/177, 178, 214.1, 183, 184, 213.1, 186, 415/224, 191; 417/424.1, 354, 423.14, 423.15, 417/423.5, 423.8; 416/247 R
See application file for complete search history.

(56) References Cited

U.S. PATENT DOCUMENTS

| | | | | | |
|---|---|---|---|---|---|
| 4,885,488 | A * | 12/1989 | Cox | 310/68 R |
| 5,676,523 | A * | 10/1997 | Lee | 415/206 |
| 5,701,045 | A * | 12/1997 | Yokozawa et al. | 310/62 |
| 5,879,141 | A * | 3/1999 | Yokozawa et al. | 417/423.7 |
| 5,940,268 | A * | 8/1999 | Miyahara et al. | 361/697 |
| 6,157,104 | A * | 12/2000 | Yokozawa et al. | 310/58 |
| 6,498,724 | B1 * | 12/2002 | Chien | 361/679.47 |
| 7,123,484 | B2 * | 10/2006 | Tsai | 361/719 |
| 7,237,599 | B2 * | 7/2007 | Lopatinsky et al. | 165/80.3 |
| 7,289,320 | B2 * | 10/2007 | Chang et al. | 361/690 |
| 7,307,843 | B2 | 12/2007 | Harman et al. | |
| 2008/0030949 | A1 * | 2/2008 | Hsiao | 361/689 |

FOREIGN PATENT DOCUMENTS

JP 405304379 A * 11/1993

* cited by examiner

*Primary Examiner*—Michael V Datskovskiy
(74) *Attorney, Agent, or Firm*—Frank R. Niranjan

(57) ABSTRACT

A heat dissipating assembly capable of being placed between a circuit board and a casing of an electronic device includes a fan assembly and a bracket. The fan assembly is mounted on the circuit board. The fan assembly includes an enclosure defining a chamber and an opening at a side wall thereof, along with a blower received in the chamber. The bracket is located between the fan assembly and the casing of the electronic device. The bracket has a side wall thereof defining a cutout connected with the chamber. The cutout and the opening of the enclosure are defined at two different sides of the heat dissipating assembly.

18 Claims, 5 Drawing Sheets

HEAT DISSIPATING ASSEMBLY AND ELECTRONIC DEVICE HAVING SAME

TECHNICAL FIELD

The present invention relates to heat dissipating fields, and particularly to a heat dissipating assembly for a circuit board and an electronic device having the same.

DESCRIPTION OF THE RELATED ART

As the operating speeds of electronic components, such as CPUs, increases, the heat generated by these components increases, as a result, the heat dissipating assemblies in the electronic devices must be able to perform in tandem with this increase in heat. Typical heat dissipating assembly includes a fan or blower for directly blowing air towards an electronic component mounted on a circuit board of the electronic device. Although this is efficient for dissipating heat within the electronic element, it is not efficient for dissipating heat within the whole circuit board.

What is needed, therefore, is a heat dissipating assembly for a circuit board to overcome the above-described problem.

BRIEF DESCRIPTION OF THE DRAWINGS

Many aspects of the present heat dissipating assembly and electronic device can be better understood with references to the accompanying drawings. The components in the drawing are not necessarily drawn to scale, the emphasis instead being placed upon clearly illustrating the principles of the present heat dissipating assembly and electronic device.

DETAILED DESCRIPTION OF THE EMBODIMENTS

Embodiments of the present invention will now be described in detail below, with references to the accompanying drawings.

Figure 1:
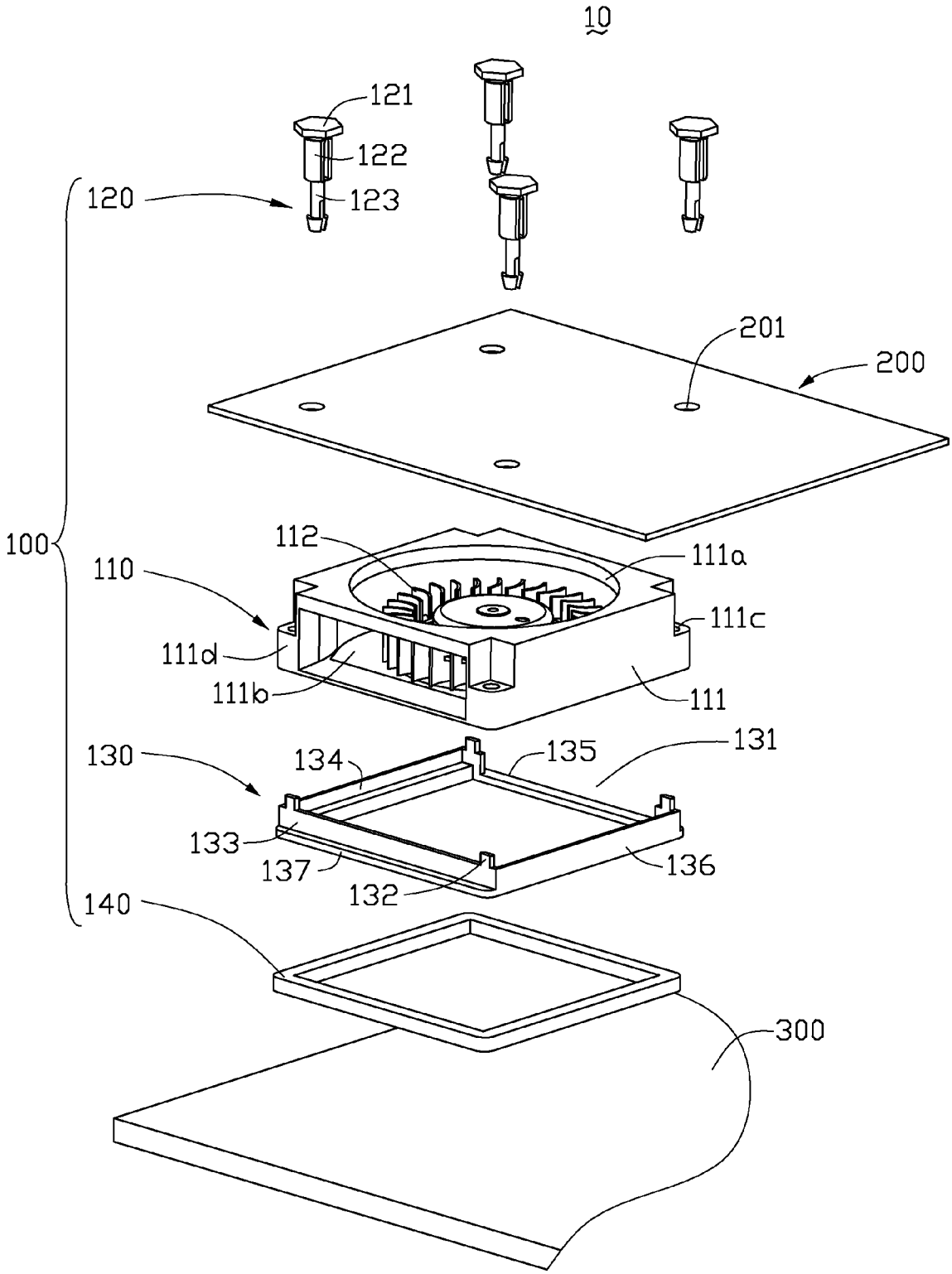
FIG. 1 is an exploded schematic view of a heat dissipating assembly according to a first exemplary embodiment.
Figure 2:
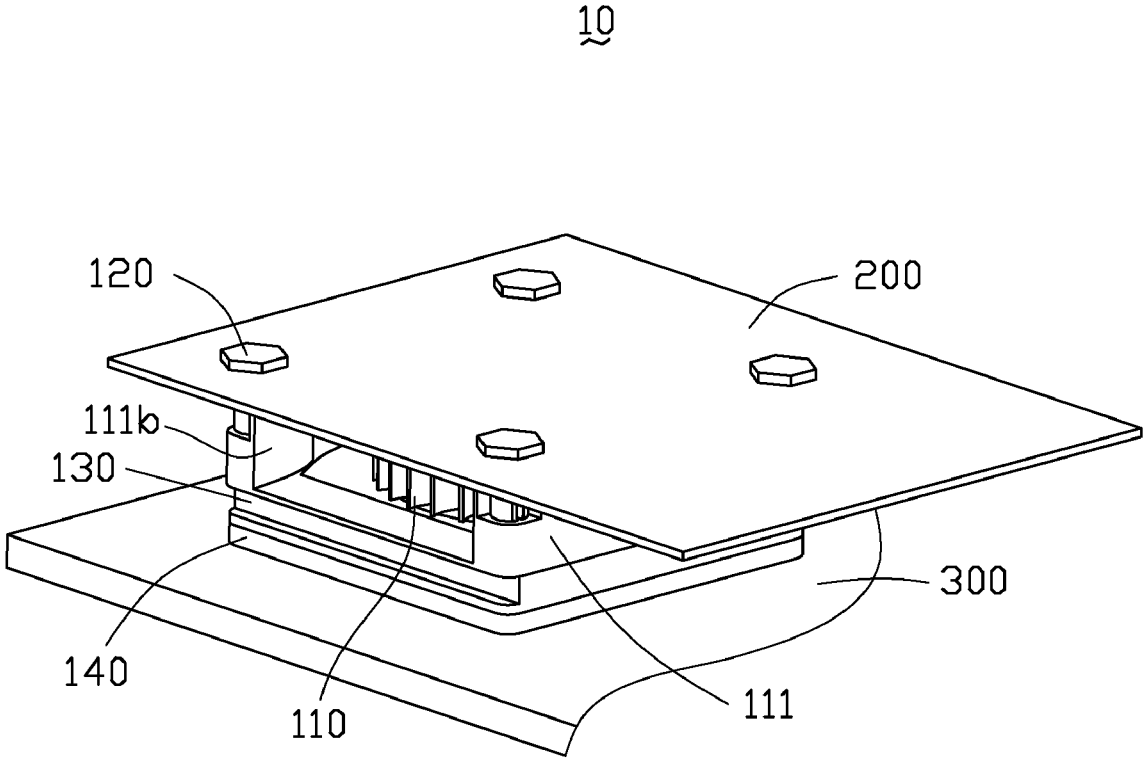
FIGS. 2 and 3 are schematic views of the heat dissipating assembly of FIG. 1 after being assembled from two angles.
Figure 3:
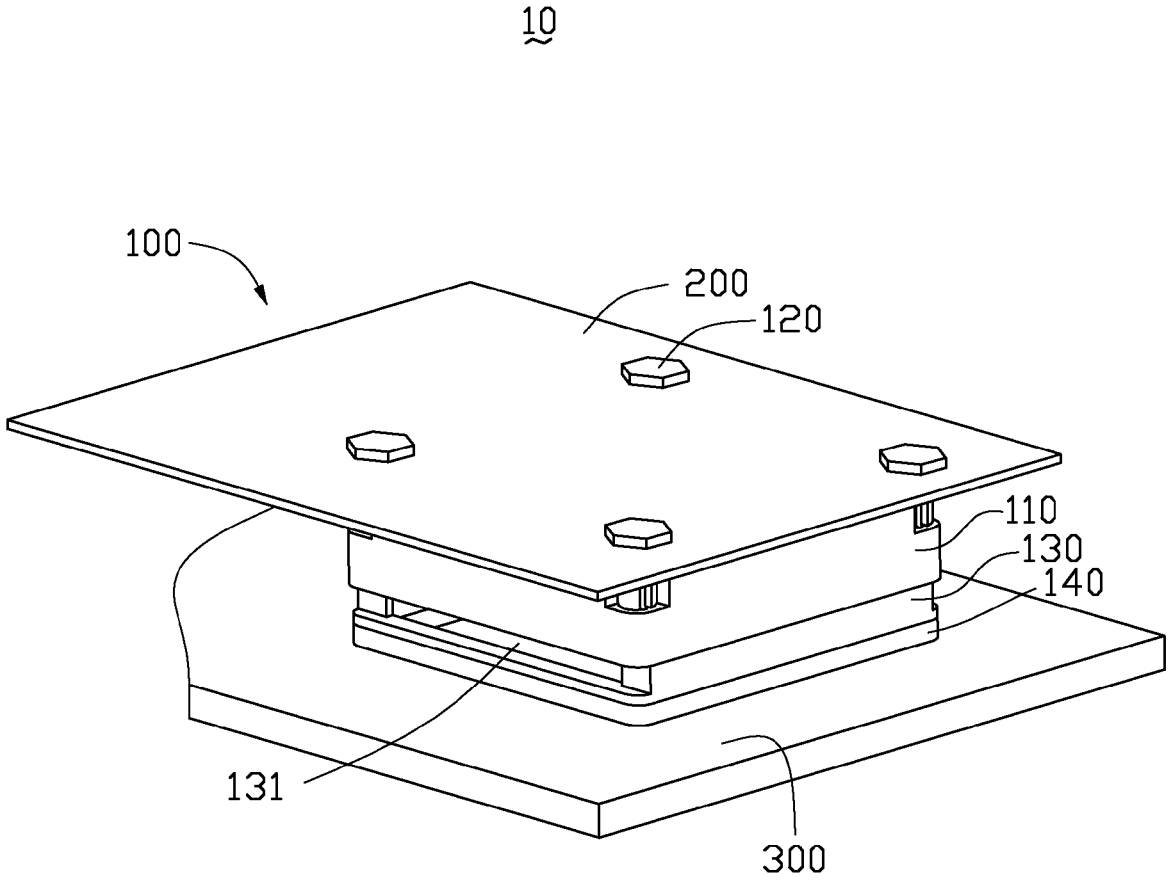

Referring to FIGS. 1 to 3, a heat dissipating assembly 100 of an electronic device 10 according to a first exemplary embodiment is shown. The heat dissipating assembly 100 is located between a circuit board 200 and a casing 300 of the electronic device 10, which is substantially parallel to the circuit board 200.

The heat dissipating assembly 100 includes a fan assembly 110, a number of fasteners 120, and a bracket 130.

The bracket 130 is mounted on the casing 300 of the electronic device 10 and is configured for supporting the fan assembly 110. In the present embodiment, the bracket 130 is mounted on the casing 300 through a foam gasket 140. A first surface of the foam gasket 140 facing the bracket 130 is attached to the bracket 130, and a second surface of the foam gasket 140 opposite the first surface is attached to the casing 300 of the electronic device 10.

The bracket 130 is a rectangular frame. The bracket 130 has a first side wall 133, a second side wall 134, a third side wall 135, and a fourth side wall 136 connected in sequence. The bracket 130 has four latching protrusions 132 located at four corners of the bracket 130 extending towards the fan assembly 110 and two wing portions 137 extending from the bottom of the first side wall 133 and the third side wall 135, respectively. The wing portions 137 can increase the area of the bracket 130 in contact with the foam gasket 140 to reinforce the connection between the bracket 130 and the foam gasket 140. The third side wall 135 defines a cutout 131 extending to an edge of the third side wall 135 facing the fan assembly 110.

The fan assembly 110 is located between the circuit board 200 and the bracket 130. The fan assembly 110 includes an enclosure 111 defining a chamber 111*a* and a blower 112 received in the chamber 111*a* of the enclosure 111. The enclosure 111 defines an opening 111*b* at a side wall 111*d* thereof. The opening 111*b* of the enclosure 111 and the cutout 131 of the bracket 130 are defined at two different sides of the heat dissipating assembly 100. In the present embodiment, the opening 111*b* of the enclosure 111 is opposite the cutout 131. The chamber 111*a* is connected with the cutout 131 and the opening 111*b*. In the present embodiment, the cutout 131 is used as an air inlet and the opening 111*b* is used as an air outlet. The enclosure 111 also defines four through holes 111*c* at the four corners of the enclosure 111 spatially corresponding to the four latching protrusions 132 of the bracket 130.

Figure 4:
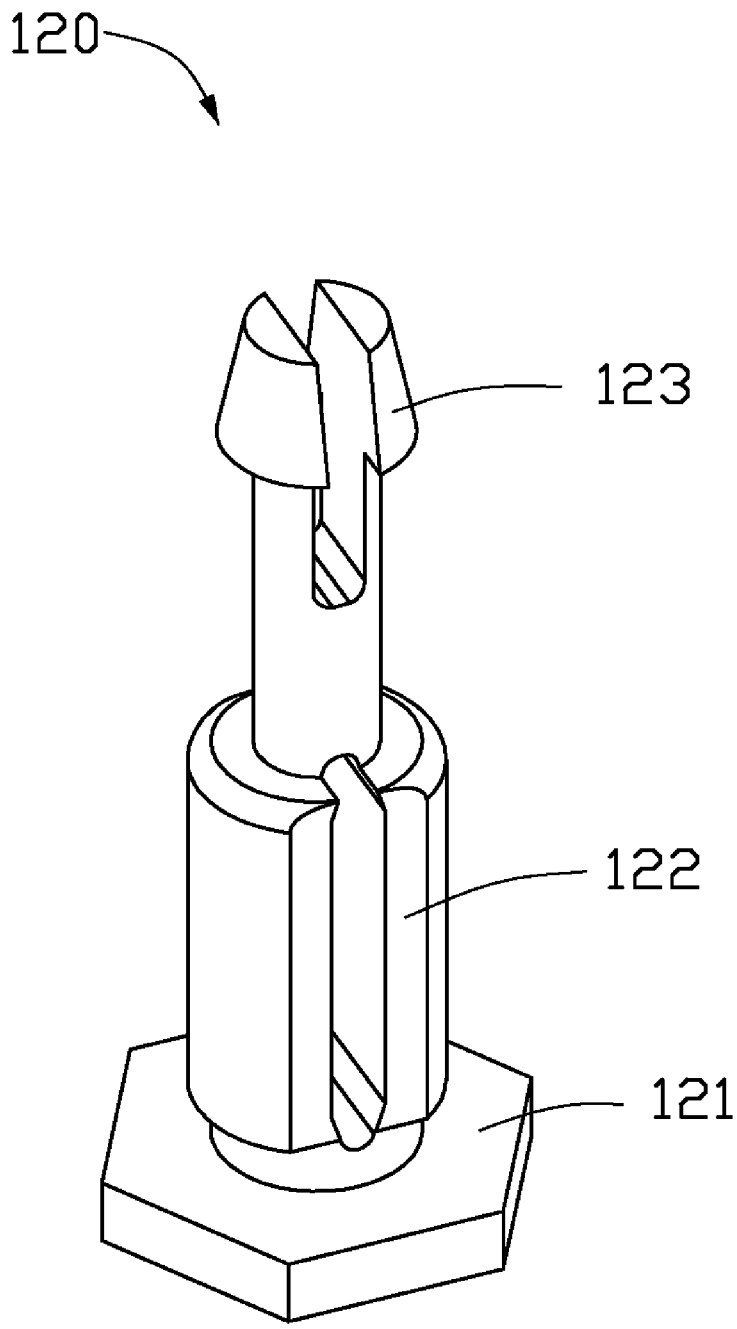
FIG. 4 is a schematic view of a fastener of the heat dissipating assembly of FIG. 1 according to the first exemplary embodiment.

The fasteners 120 are configured for securing the heat dissipating assembly 100 to the circuit board 200. Referring to FIG. 4, in the present embodiment, each fastener 120 includes a base 121, a connecting portion 122, and a latching portion 123. The connecting portion 122 extends from the base 121 along a direction away from the base 121. The latching portion 123 is located at an end of the connecting portion 122 away from the base 121. The fasteners 120 can secure the fan assembly 110 to the circuit board 200 by inserting the connecting portion 122 through a hole 201, of the circuit board 200, and the through hole 111*c* of the enclosure 111 to latch with the latching protrusions 132 of the bracket 130 by the latching portion 123. In the present embodiment, the fasteners 120 are made of plastic. The fasteners 120 are not limited to the above structure, the fasteners 120 can also be screws, among other structures, which can secure the heat dissipating assembly 100 to the circuit board 200.

The heat dissipating assembly 100 is directly secured on the circuit board 200 and defines the air outlet thereof substantially parallel to the circuit board 200. Therefore, the heat dissipating assembly 100 can blow the air close to the circuit board 200 efficiently and improve the efficiency of dissipating heat of the circuit board 200.

Figure 5:
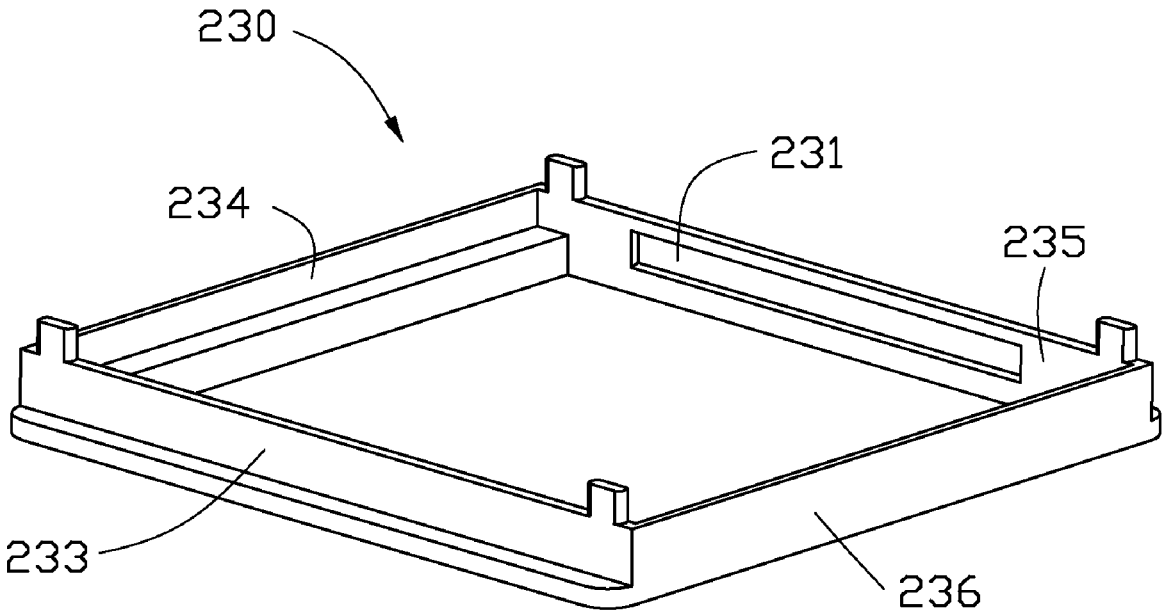
FIG. 5 is a schematic view of a bracket of a heat dissipating assembly according to a second exemplary embodiment.

Referring to FIG. 5, a bracket 230 according to a second exemplary embodiment is shown. The bracket 230 is similar to the bracket 130 of the first embodiment. The bracket 230 includes a first side wall 233, a second side wall 234, a third side wall 235, and a fourth side wall 236 connected in sequence. The difference between the bracket 230 and the bracket 130 is that the third side wall 235 defines a cutout 231 that is surrounded by the third side wall 235.

While certain embodiments have been described and exemplified above, various other embodiments will be apparent to those skilled in the art from the foregoing disclosure. The present invention is not limited to the particular embodiments described and exemplified, and the embodiments are capable of considerable variation and modification without departure from the scope of the appended claims.

What is claimed is:

1. A heat dissipating assembly for a circuit board of an electronic device, the heat dissipating assembly is capable of being placed between the circuit board and a casing of the electronic device, the heat dissipating assembly comprising:

a fan assembly mounted on the circuit board, the fan assembly comprising:

an enclosure defining a chamber and an opening at a side wall thereof; and a blower received in the chamber, and a bracket located between the fan assembly and the casing of the electronic device, the bracket being mounted on the casing of the electronic device and having a side wall thereof defining a cutout connected with the chamber, the cutout and the opening at the side wall of the enclosure being defined at two different sides of the heat dissipating assembly.

2. The heat dissipating assembly as claimed in claim 1, wherein the heat dissipating assembly further comprises a plurality of fasteners for securing the heat dissipating assembly to the circuit board.

3. The heat dissipating assembly as claimed in claim 2, wherein the fasteners are screws.

4. The heat dissipating assembly as claimed in claim 2, wherein each fastener comprises a base, a connecting portion, and a latching portion, the connecting portion extends from the base along a direction away from the base and the latching portion is located at an end of the connecting portion away from the base, the bracket has a plurality of latching protrusions extending towards the fan assembly for latching with the latching portions.

5. The heat dissipating assembly as claimed in claim 4, wherein the bracket has four latching protrusions located at four corners thereof.

6. The heat dissipating assembly as claimed in claim 4, wherein the fasteners are made of plastic.

7. The heat dissipating assembly as claimed in claim 1, wherein the heat dissipating assembly further comprises a foam gasket with a surface attached to the bracket and an opposite surface attached to the casing of the electronic device.

8. The heat dissipating assembly as claimed in claim 1, wherein the cutout of the bracket is opposite to the opening of the enclosure.

9. The heat dissipating assembly as claimed in claim 1, wherein the cutout of the bracket extends towards an edge of the side wall facing the fan assembly.

10. An electronic device comprising:

a circuit board;

a casing substantially parallel to the circuit board; and a heat dissipating assembly comprising:

a fan assembly mounted on the circuit board, the fan assembly comprising an enclosure defining a chamber and an opening at a side wall thereof and a blower received in the chamber, and a bracket located between the fan assembly and the casing of the electronic device, the bracket being mounted on the casing of the electronic device and having a side wall thereof defining a cutout connected with the chamber, the cutout and the opening of the enclosure being defined at two different sides of the heat dissipating assembly.

11. The electronic device as claimed in claim 10, wherein the heat dissipating assembly further comprising a plurality of fasteners for securing the heat dissipating assembly to the circuit board.

12. The electronic device as claimed in claim 11, wherein the fasteners are screws.

13. The electronic device as claimed in claim 11, wherein each fastener comprises a base, a connecting portion, and a latching portion, the connecting portion extends from the base along a direction away from the base and the latching portion is located at an end of the connecting portion away from the base, the bracket has a plurality of latching protrusions extending towards the fan assembly for latching with the latching portions.

14. The electronic device as claimed in claim 13, wherein the bracket has four latching protrusions located at four corners thereof.

15. The electronic device as claimed in claim 13, wherein the fasteners are made of plastic.

16. The electronic device as claimed in claim 10, wherein the heat dissipating assembly further comprises a foam gasket with a surface attached to the bracket and an opposite surface attached to the casing of the electronic device.

17. The electronic device as claimed in claim 10, wherein the cutout of the bracket is opposite the opening of the enclosure.

18. The electronic device as claimed in claim 10, wherein the cutout of the bracket extends towards an edge of the side wall facing the fan assembly.

* * * * *